US006345168B1

(12) United States Patent
Pitts

(10) Patent No.: US 6,345,168 B1
(45) Date of Patent: Feb. 5, 2002

(54) XEROGRAPHIC PRINTER WHERE DC BIAS IS CHANGED TO ZERO DURING THE TRANSFER STEP

(75) Inventor: Ian Pitts, Bassingbourn (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/736,740

(22) Filed: Dec. 14, 2000

(51) Int. Cl.[7] ..... G03G 15/16
(52) U.S. Cl. ..... 399/314; 399/66
(58) Field of Search ..... 399/313, 314, 399/66

(56) References Cited

U.S. PATENT DOCUMENTS

| | | | | |
|---|---|---|---|---|
| 4,190,348 A | | 2/1980 | Friday | 355/3 TR |
| 5,083,167 A | | 1/1992 | Fukushima et al. | 355/274 |
| 5,287,163 A | | 2/1994 | Miyashiro et al. | 355/326 R |
| 5,410,393 A | | 4/1995 | Watanabe | 355/273 |
| 5,541,718 A | | 7/1996 | Oono | 355/271 |
| 5,598,256 A | | 1/1997 | Kimura et al. | 399/316 |
| 6,009,286 A | | 12/1999 | Watanabe et al. | 399/44 |
| 6,167,229 A | * | 12/2000 | Watanabe et al. | 399/313 |

FOREIGN PATENT DOCUMENTS

| | | |
|---|---|---|
| JP | 08-272232 | * 10/1996 |

* cited by examiner

*Primary Examiner*—Quana M. Grainger
(74) *Attorney, Agent, or Firm*—R. Hutter

(57) ABSTRACT

In a xerographic printing apparatus, during the transfer step wherein marking material is electrostatically transferred from the photoreceptor to the print sheet and the sheet is then detached from the photoreceptor, a DC bias starts at a high absolute value when the lead edge of the sheet is proximate the photoreceptor, and is then decreased as different portions of the sheet pass the photoreceptor. The DC bias can be decreased to zero in the course of the transfer step, or can change sign by the time the trail edge is transferred.

20 Claims, 3 Drawing Sheets

XEROGRAPHIC PRINTER WHERE DC BIAS IS CHANGED TO ZERO DURING THE TRANSFER STEP

FIELD OF THE INVENTION

The present invention relates to the transfer step in electrostatographic printing, such as xerography, wherein marking material is electrostatically transferred from a charge receptor onto a print sheet.

BACKGROUND OF THE INVENTION

The basic process steps of electrostatographic printing, such as xerography or ionography, are well known. Typically an electrostatic latent image is created on a charge receptor, which in a typical analog copier or "laser printer" is known as a photoreceptor. The suitably charged areas on the photoreceptor surface are developed with fine toner particles, creating an image with the toner which is transferred to a print sheet, which is typically a sheet of paper but which could conceivably be any kind of substrate. This transfer is typically carried out by the creation of a "transfer zone" of AC and DC biases where the print sheet is in contact with, or otherwise proximate to, the photoreceptor. In general, the AC bias dislodges the toner particles which were adhering electrostatically to the photoreceptor, while the DC bias, also known as a "detack voltage," causes the particles to be attracted in imagewise fashion to the print sheet, thus transferring the image from the photoreceptor the print sheet. Devices to create this transfer zone, such as corotrons, are well known.

It has been found, particularly in the design of compact copiers and printers, that the quality of image transfer can vary between a lead edge of a print sheet (i.e., the first edge of the sheet that approaches the photoreceptor) and the trail edge (i.e., the last portion of the sheet to be close to the photoreceptor). Depending on a specific design, there may be any number of reasons for this. For instance, when relatively heavy papers are used, the trail edge of each sheet may not be in the same tight contact with the photoreceptor as the lead edge had been. Also, in a small machine, the trail edge of the sheet may still be in the transfer zone while most of the sheet is in or past the fuser, and mechanical disturbances from the fuser may travel through the print sheet during the last part of the transfer step.

The present invention relates to a method of controlling the transfer step, to obviate the above-mentioned practical difficulties.

DESCRIPTION OF THE PRIOR ART

U.S. Pat. No. 4,190,348 discloses a xerographic transfer system in which a non-uniform increase in transfer charge is applied to the lead edge of each copy to improve the effective image transfer.

U.S. Pat. No. 5,083,167 discloses a transfer device which supplies a different electric charge amount per area to an end of the transfer material relative to the rest of the transfer material. FIGS. 7 and 9 show how charge is ramped up immediately before a sheet is transferred, and ramped down immediately thereafter.

U.S. Pat. No. 5,287,163 discloses a transfer system in which the transfer bias is progressively increased, in absolute terms, between a leading and trailing edge of a sheet having an image transferred thereto.

U.S. Pat. No. 5,410,393 discloses, at FIG. 4 thereof, a transfer system in which the bias is briefly set to a first polarity just before transfer of a sheet, and then set to the opposite polarity for the duration of the transfer step.

U.S. Pat. No. 5,541,718 discloses a transfer system in which the transfer bias is altered depending on whether a sheet is being guided by one or another guide member adjacent to the transfer zone.

U.S. Pat. No. 5,598,256 discloses, at FIG. 2 thereof, a transfer system in which the strength of the transfer field is momentarily spiked between feeding the leading edge of a sheet, and transferring the leading edge of an image to be placed on the sheet.

U.S. Pat. No. 6,009,286 discloses a transfer device in which a relatively high transfer field is provided at both the leading edge and trailing edge of a sheet being transferred.

SUMMARY OF THE INVENTION

According to the present invention, there is provided a method of transferring marking material from a charge receptor to a print sheet in an electrostatographic printing apparatus. The print sheet is moved relative to the charge receptor in a process direction through a transfer zone, whereby the print sheet presents to the charge receptor a lead edge and a trail edge. When the lead edge is in the transfer zone, an initial DC bias is provided between the print sheet and the charge receptor. During the moving step, the DC bias is decreased in absolute terms to at least zero before the trail edge enters the transfer zone.

DETAILED DESCRIPTION OF THE INVENTION

Figure 1:
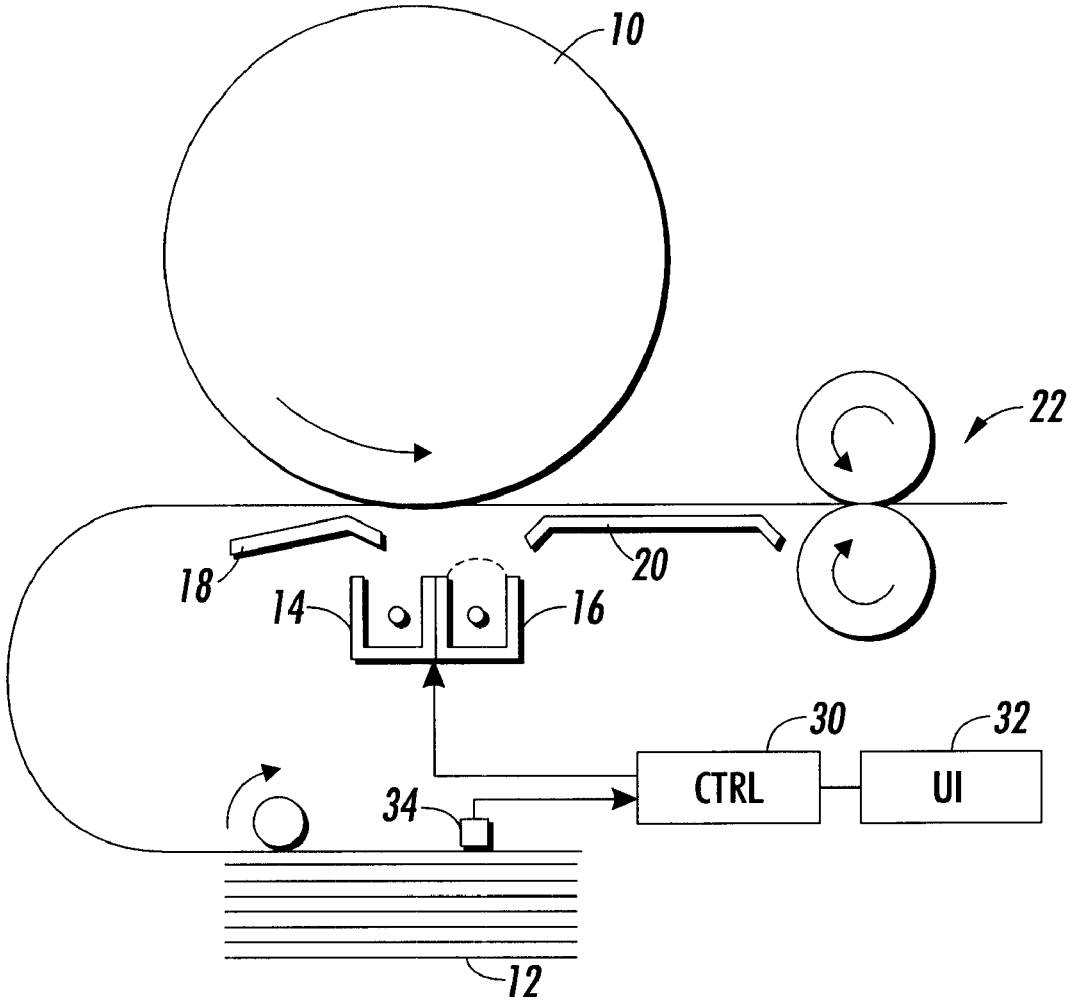
FIG. 1 is a simplified elevational diagram showing the essential elements of an electrostatographic printing apparatus, such as a printer or copier, relevant to the present invention.
Figure 2:
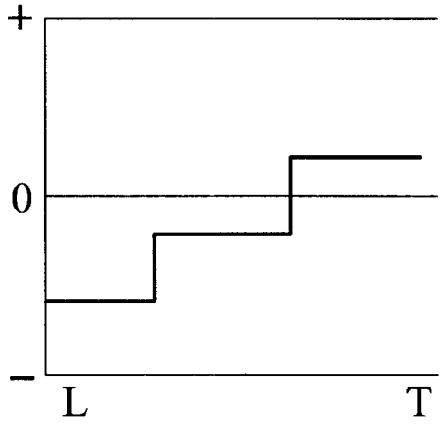
FIGS. 2–5 are a set of possible behaviors of a DC bias in a transfer zone such as shown in FIG. 1, according to various embodiments of the present invention.

FIG. 1 is a simplified elevational diagram showing the essential elements of an electrostatographic printing apparatus, such as a printer or copier, relevant to the present invention. As is familiar in electrostatographic printing, in particular ionography or xerography, electrostatic latent images are created on the surface of a charge receptor, such as the photoreceptor indicated as 10. (The ancillary elements typically associated with such a printer, such as a charge corotron, exposure device, development unit, and so forth, are not shown but would be apparent to one of skill in the art. Also, consistent with the claims hereinbelow, a charge receptor can be an intermediate member, such as a belt, on which successive toner images are accumulated before final transfer, such as in color xerography.) The sheets on which images are desired to be printed are drawn from a stack 12 and brought into what can generally be called a "transfer zone" which, depending on a particular design of apparatus, typically involves contact of the sheet with the surface of the photoreceptor. As the term is used herein, the transfer zone is the location in which the sheet is presented to the charge receptor to receive marking material therefrom, and then detached from the charge receptor, such as to be directed to a fusing apparatus. When a sheet is passed through the transfer zone through a process direction, first a lead edge and then finally a trail edge of the sheet will be presented to the charge receptor.

In the particular illustrated embodiment, there is provided, in the transfer zone, two charge emitting devices, a transfer corotron 14, and a detack corotron 16. The basic design of such corotrons are well known in the art; the essential function of each corotron is to emit charge of a certain magnitude and polarity into at least a portion of the transfer zone. More specifically, transfer corotron 14 is intended to have the main function of electrostatically dislodging the marking material on the surface of photoreceptor 10 so that it instead adheres to the sheet, while the function of detack corotron 16 is to use electrostatic forces to detach the sheet from the surface of photoreceptor 10. In other conceivable embodiments, the functions of transfer and detack can be combined in a single corotron, or alternately the transfer functions can be carried out by the use of a biasable transfer roll which forms a nip with the photoreceptor, through which the sheets pass.

Typically, there is provided adjacent to the transfer zone various paper guides to ensure suitable interaction between a sheet and the photoreceptor. Typical of such guides include a "halo guide" 18, which typically extends over the effective area of a transfer corotron such as 14, and a paper path guide such as 20, which guides a sheet from the transfer zone toward the nip of a fusing apparatus such as generally indicated by 22.

With certain specific designs of electrostatographic printing apparatus, the behavior of the deliberately-induced electrical fields in a transfer zone, such as created by transfer corotron 14, detack corotron 16, or their equivalents in different devices, has a profound effect on print quality, particularly within a single printed sheet. In brief, the electrostatic conditions which are optimal for transfer of marking material at a leading edge of a sheet being fed through the transfer zone may be significantly different from the optimal electrostatic conditions for the middle of the sheet, or for the trailing edge of the sheet. As mentioned above, there may be several reasons for this: first, a leading edge of a sheet may require a greater electrical force for detachment from the photoreceptor than the middle of a sheet, and, particularly in smaller machines, the trailing edge of a sheet will still be in the transfer zone even as much of the sheet is already entered into the fuser. The present invention is directed toward controlling the electrical fields in the transfer zone relative to different portions of a sheet being fed therethrough.

In a preferred embodiment of the present invention, there is provided, in a transfer zone, both an AC bias and a DC bias. In one practical embodiment of the present invention, for detack purposes, this AC bias has a root-mean-square value of 420V, and frequency of about 400–600 Hz. A function of the biases is to assist in detaching, or "detacking," the sheet from the surface of the photoreceptor 10, so that the lead edge of the sheet can be directed toward the nip of the fuser 22. With particular reference to the embodiment of FIG. 1, the detack biases are provided by detack corotron 16 which is separate from a transfer corotron 14, although in different embodiments the transfer and detack biases could be provided by a single corotron, or conceivably by another type of device, such as a bias transfer roll urged against the photoreceptor.

FIGS. 2–5 are a series of graphs showing the behavior of a DC bias in the transfer zone according to various embodiments of the present invention. In each case, what is being illustrated is the overall DC bias magnitude, both negative and positive, over time as a single particular sheet passes through the transfer zone. As this sheet passes through the transfer zone, there will first be presented in the transfer zone a lead edge, represented in the various figures by L, and finally a trail edge, represented by T. Of course, the space between L and T corresponds to the bulk of the sheet being fed. As can be seen it in each case, the initial DC bias in the transfer zone starts at a relatively high negative value (in a practical embodiment, typically in the range of −75V to −60V) when the lead edge L enters the transfer zone, and then decreases in absolute value toward zero as the trail edge T is approached.

Figure 3:
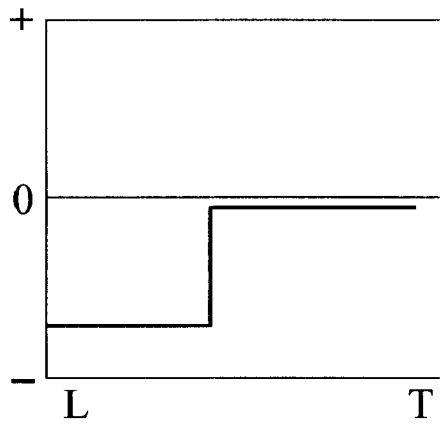
Figure 4:
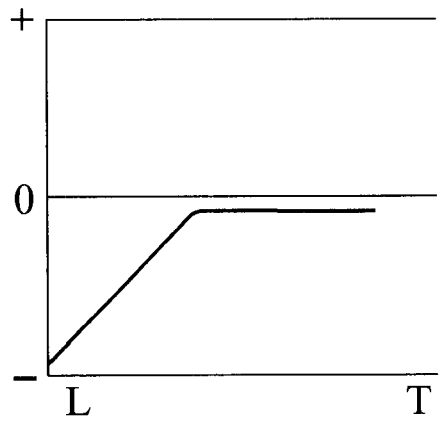
Figure 5:
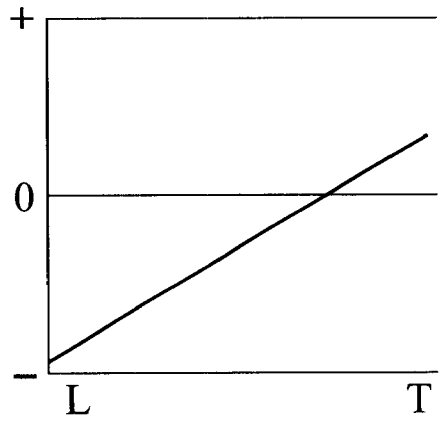

In the embodiments of FIGS. 3 and 4, it can be seen that the initial high negative bias is either abruptly (FIG. 3) or linearly (FIG. 4) decreased to zero somewhere in the middle of the process of transferring marking material to the sheet, and then the bias remains at zero for the balance of the transfer process.

In the embodiments of FIGS. 2 and 5, once again the initial DC bias in the transfer zone when a leading edge L enters the transfer zone is a relatively high negative (typically, −75V to −60V). As the sheet is fed through the transfer zone, the bias is either linearly (FIG. 5) or discretely (FIG. 2) brought closer to zero, and, at some point in the transfer process, goes through zero and in fact changes sign, in these particular cases going from an initial negative to final positive. In a practical embodiment of the present invention, by the time the trail edge approaches the transfer zone, the DC bias is made to go positive by 20 to 40 volts. In one embodiment of a printing apparatus known to the inventor as of the filing hereof, the FIG. 2 configuration provided the best practical results.

The varying of the DC bias in the transfer zone will of course be ultimately controlled by a control system within the printing apparatus, and this control system is generally shown in FIG. 1 as 30. The control system 30 can independently operate either the transfer corotron 14 or the detack corotron 16 to obtain the desired electrical properties within the transfer zone during the transfer process. As further can be seen in the Figure, the control system 30 can be ultimately accessed via a user interface (UI) indicated as 32. According to a preferred embodiment of the present invention, a particular behavior of the DC bias in the transfer zone may be most useful only for a particular type of sheet, most importantly for a particular weight of sheet. In other words, in a particular design of an electrostatographic printing apparatus, relatively heavy weight papers may not require the variation of the DC bias for detacking purposes, while lighter papers may benefit from the variation of the DC bias. In a sophisticated embodiment, specific weights and types of paper being fed through the machine can be mapped to very specific behaviors of the DC bias. The entry of a specific sheet weight at a particular time, in a way which would influence the control system 30 to provide a particular DC bias behavior during transfer, can be provided through user interface: that is, at one point a human user can enter the weights of different stocks in different paper supplies, and when a sheet is fed from a particular paper supply of the weight thereof would be noted. During printing, the determined weight of the sheet is mapped to, for instance, a suitable initial bias voltage for optimized performance. Alternately there could be provided some sort of sensor, such as 34, which would be capable of determining the type or other quality of the paper at a particular stack 12, and then relay this information to the control system 30. This principle affecting the behavior of the DC bias during transfer can be applied not only to the weight of the paper, but to other qualities of sheets as well, such as whether the sheets are coated paper or transparencies.

A sensor such as 34, or some equivalent means, is also useful in conjunction with the present invention for the purpose of determining the size of a type of sheet in a particular stack, for instance whether the sheets in a particular stack are letter size, A4, A3, or whatever. Clearly, the specific size of a sheet being fed through the apparatus will determine the precise timing of the changes in bias such as shown in FIGS. 2–5: with a sheet which is smaller in the process direction between its lead edge L and its trail edge T, the steps in any of the figures will of course be of relatively shorter duration, assuming a constant velocity for all sheet sizes. This coordination of the timing of the bias changes during the transfer process with the determined size of a particular sheet being printed upon can be carried out within control system 30, based on input from either a user interface 32 or one or more sensors such as 34.

As mentioned above, in some compact designs of copiers and printers, a common situation is that the lead edge of a particular sheet will have entered a fusing apparatus 22 downstream of photoreceptor 10, while portions of the same sheet, leading up to the trail edge, will be still in the process of having marking material transferred thereto from the photoreceptor 10. As a practical matter, once a leading edge of a sheet in is taken up within the rollers of the fusing apparatus 22, detacking forces on the remainder of the sheet may not be necessary, and vibration and other forces from the fusing apparatus 22 may be transmitted along the sheet to interfere with the transfer process near the trail edge. According to one significant implementation of the present invention, the changes in the DC bias in the transfer zone can be to some extent coordinated with the behavior of the sheet in the fusing apparatus 22. For instance, with regard to the FIG. 2 embodiment, the third stage of the transfer process, in which the DC bias becomes a slight positive (as opposed to the initial negative bias), can be coordinated to begin approximately around the time the leading edge of the sheet is taken up by the fusing apparatus. With the FIG. 3 embodiment, the abrupt shifts of bias down to zero generally coordinate with the entry of the leading edge into the fusing apparatus. In the FIG. 4 embodiment, similarly, the DC bias can be decreased in a linear fashion to reach zero at roughly the time the lead edge enters the fusing apparatus. Finally, in the FIG. 5 embodiment, the positive (i.e., opposite) bias portion of the transfer process can be coordinated to begin with the entry of the leading edge into the fusing apparatus. Generally, in all cases, the detacking force associated with a high initial bias is minimized or eliminated by the time the fusing apparatus "takes over" the motion of the sheet through the machine. In this way, vibrations and other forces from the fusing apparatus 22 are less likely to interfere with the transfer process toward the trail edge of the sheet.

What is claimed is:

1. A method of transferring marking material from a charge receptor to a print sheet in an electrostatographic printing apparatus, comprising the steps of:

moving the print sheet relative to the charge receptor in a process direction through a transfer zone, whereby the print sheet presents to the charge receptor a lead edge and a trail edge;

providing, when the lead edge is in the transfer zone, an initial DC bias between the print sheet and the charge receptor;

during the moving step, decreasing, in absolute terms, the DC bias to at least zero before the trail edge enters the transfer zone.

2. The method of claim 1, the decreasing step including decreasing the DC bias in a linear manner.

3. The method of claim 1, the decreasing step including decreasing the DC bias in at least one discrete step.

4. The method of claim 1, the decreasing step including decreasing the DC bias so that the DC bias changes sign during the moving step.

5. The method of claim 1, the decreasing step including decreasing the DC bias so the DC bias reaches zero during the moving step, and then remains at zero for a balance of the moving step.

6. The method of claim 1, further comprising the steps of determining a quality of the print sheet; and activating the decreasing step only if the sheet is of a predetermined quality.

7. The method of claim 6, wherein the quality is being at least a predetermined weight.

8. The method of claim 1, further comprising the steps of determining a quality of the print sheet; and determining the initial DC bias as a result of determining the quality of the print sheet.

9. The method of claim 1, wherein the lead edge of the print sheet is disposed in a fusing apparatus while the trail edge of the print sheet is proximate to the charge receptor.

10. The method of claim 9, the decreasing step including setting the DC bias to approximately zero after the lead edge of the print sheet is disposed in the fusing apparatus.

11. The method of claim 9, the decreasing step including setting the DC bias to a polarity opposite a polarity of the initial DC bias after the lead edge of the print sheet is disposed in the fusing apparatus.

12. The method of claim 1, further comprising the step of providing an AC bias between the print sheet and the charge receptor.

13. The method of claim 1, further comprising the step of providing a transfer corotron and a detack corotron; and wherein the DC bias is provided by at least one of the transfer corotron and the detack corotron.

14. An electrostatographic printing apparatus, comprising:

a charge receptor;

means for moving the print sheet relative to the charge receptor in a process direction through a transfer zone, whereby the print sheet presents to the charge receptor a lead edge and a trail edge;

means for providing, when the lead edge is in the transfer zone, an initial DC bias between the print sheet and the charge receptor; and means for decreasing, in absolute terms, the DC bias to at least zero before the trail edge enters the transfer zone.

15. The apparatus of claim 14, the decreasing means decreasing the DC bias in a linear manner.

16. The apparatus of claim 14, the decreasing means decreasing the DC bias in at least one discrete step.

17. The apparatus of claim 14, the decreasing means decreasing the DC bias so that the DC bias changes sign.

18. The apparatus of claim 14, the decreasing means decreasing the DC bias so the DC bias reaches zero, and then remains at zero until the trail edge of the sheet leaves the transfer zone.

19. The apparatus of claim 14, further comprising means for determining a quality of the print sheet; and means for activating the decreasing means only if the sheet is of a predetermined quality.

20. The apparatus of claim 14, further comprising a transfer corotron and a detack corotron; and wherein the DC bias is provided by at least one of the transfer corotron and the detack corotron.

* * * * *